US012571154B2

(12) United States Patent
Khizar et al.

(10) Patent No.: US 12,571,154 B2
(45) Date of Patent: Mar. 10, 2026

(54) LAUNDRY APPLIANCE HAVING A MICRO-PARTICLE FILTRATION AND COLLECTION SYSTEM

(71) Applicant: WHIRLPOOL CORPORATION, Benton Harbor, MI (US)

(72) Inventors: Muhammad Khizar, St. Joseph, MI (US); Omar R. Murad, Rio Claro (BR)

(73) Assignee: Whirlpool Corporation, Benton Harbor, MI (US)

( * ) Notice: Subject to any disclaimer, the term of this patent is extended or adjusted under 35 U.S.C. 154(b) by 235 days.

(21) Appl. No.: 18/290,993

(22) PCT Filed: Sep. 27, 2022

(86) PCT No.: PCT/IB2022/059184

§ 371 (c)(1),
(2) Date: Jan. 22, 2024

(87) PCT Pub. No.: WO2023/047385

PCT Pub. Date: Mar. 30, 2023

(65) Prior Publication Data

US 2024/0328059 A1 Oct. 3, 2024

Related U.S. Application Data

(60) Provisional application No. 63/248,565, filed on Sep. 27, 2021.

(51) Int. Cl.

| | |
|---|---|
| ***D06F 39/10*** | (2006.01) |
| ***D06F 25/00*** | (2006.01) |
| ***D06F 39/08*** | (2006.01) |
| ***D06F 58/22*** | (2006.01) |

(52) U.S. Cl.
CPC ..... *D06F 39/10* (2013.01); *D06F 25/00* (2013.01); *D06F 39/085* (2013.01); *D06F 58/22* (2013.01)

(58) Field of Classification Search
CPC ..... D06F 39/10
See application file for complete search history.

(56) References Cited

U.S. PATENT DOCUMENTS

| | | | |
|---|---|---|---|
| 7,210,182 | B2 | 5/2007 | Fyvie et al. |
| 8,485,367 | B2 | 7/2013 | Mathew et al. |
| 9,216,915 | B2 | 12/2015 | Pfeffer et al. |
| 11,066,771 | B2 | 7/2021 | Zarcone et al. |
| 11,576,551 | B2 | 2/2023 | Albert et al. |
| 2003/0196282 | A1 | 10/2003 | Fyvie et al. |
| 2010/0116746 | A1 | 5/2010 | Pfeffer et al. |
| 2020/0199804 | A1 | 6/2020 | Magnusson |

(Continued)

FOREIGN PATENT DOCUMENTS

| | | | |
|---|---|---|---|
| DE | 102019216339 | A1 | 4/2021 |
| EP | 3712320 | A1 | 9/2020 |

(Continued)

*Primary Examiner* — Jason Y Ko
(74) *Attorney, Agent, or Firm* — Price Heneveld LLP

(57) ABSTRACT

A laundry appliance includes a tub that is positioned within an outer cabinet. A processing space is defined within the tub. A fluid path delivers a process fluid through the tub for treating articles within the processing space. A micro-particle filter is positioned within the fluid path. The micro-particle filter separates micro-sized particles from the process fluid. A secondary flow mechanism delivers the micro-sized particles from the micro-particle filter to a removable collection chamber.

20 Claims, 15 Drawing Sheets

(56) References Cited

U.S. PATENT DOCUMENTS

| | | | |
|---|---|---|---|
| 2020/0270795 | A1 | 8/2020 | Zarcone et al. |
| 2020/0316501 | A1 | 10/2020 | Jones |
| 2020/0337518 | A1 | 10/2020 | Albert et al. |
| 2022/0298712 | A1 | 9/2022 | Mattley et al. |
| 2023/0330568 | A1 | 10/2023 | Root et al. |

FOREIGN PATENT DOCUMENTS

| | | | |
|---|---|---|---|
| EP | 3832001 | A1 | 6/2021 |
| JP | H0716576 | A | 1/1995 |
| KR | 101779422 | B1 | 9/2017 |
| KR | 20180077667 | A | 7/2018 |
| WO | 2008060940 | A2 | 5/2008 |
| WO | 2018198649 | A1 | 11/2018 |
| WO | 2019045632 | A1 | 3/2019 |
| WO | 2019081013 | A1 | 5/2019 |
| WO | 2019122862 | A1 | 6/2019 |
| WO | 2021032986 | A1 | 2/2021 |
| WO | 2021070103 | A1 | 4/2021 |
| WO | 2021116933 | A1 | 6/2021 |

LAUNDRY APPLIANCE HAVING A MICRO-PARTICLE FILTRATION AND COLLECTION SYSTEM

BACKGROUND OF THE DISCLOSURE

The present disclosure generally relates to laundry appliances, and more specifically, laundry appliances that include filtration systems for separating micro-sized particles from fluid used within the performance of various laundry cycles.

SUMMARY OF THE DISCLOSURE

According to one aspect of the present disclosure, a laundry appliance includes a tub that is positioned within an outer cabinet. A processing space is defined within the tub. A fluid path delivers a process fluid through the tub for treating articles within the processing space. A micro-particle filter is positioned within the fluid path. The micro-particle filter separates micro-sized particles from the process fluid. A secondary flow mechanism delivers the micro-sized particles from the micro-particle filter to a removable collection chamber.

According to another aspect of the present disclosure, a laundry appliance includes a tub that is positioned within an outer cabinet. A processing space is defined within the tub. A fluid path delivers a process fluid through the tub for treating articles within the processing space. The fluid path has a recirculating fluid path that recirculates at least a portion of the process fluid. A primary filter is positioned within the fluid path. The primary filter separates lint particles from the process fluid. A micro-particle filter is positioned within the fluid path and is downstream of the primary filter. The micro-particle filter separates micro-sized particles from the process fluid. A secondary flow mechanism delivers the micro-sized particles from the micro-particle filter to a removable collection chamber.

According to yet another aspect of the present disclosure, a particulate filtration system for a laundry appliance includes a primary filter that is positioned within a fluid path. The primary filter separates lint particles from process fluid that is delivered through the fluid path. A micro-particle filter is positioned within the fluid path and is downstream of the primary filter. The micro-particle filter separates micro-sized particles from the process fluid. A secondary flow mechanism delivers the micro-sized particles from the micro-particle filter to a removable collection chamber. The secondary flow mechanism is defined by a secondary flow of the process fluid through a downstream side of the micro-particle filter, and a secondary flow of the process fluid is a recycled portion of the process fluid that is directed between a backflow pump chamber and the removable collection chamber.

These and other features, advantages, and objects of the present disclosure will be further understood and appreciated by those skilled in the art by reference to the following specification, claims, and appended drawings.

Figure 1:
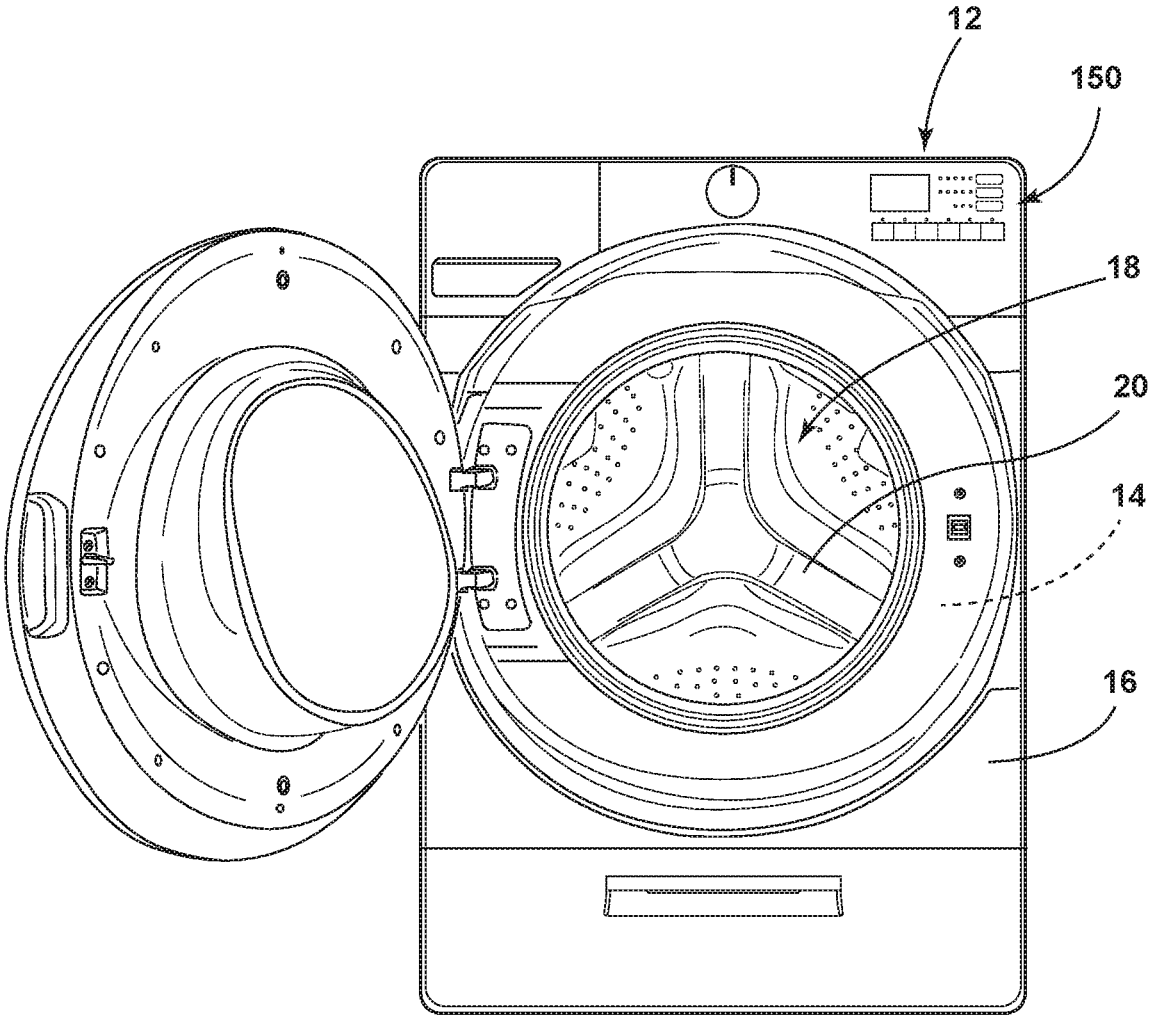
FIG. 1 is a front perspective view of a front load washing appliance that incorporates an aspect of the micro-particle filter.
Figure 2:
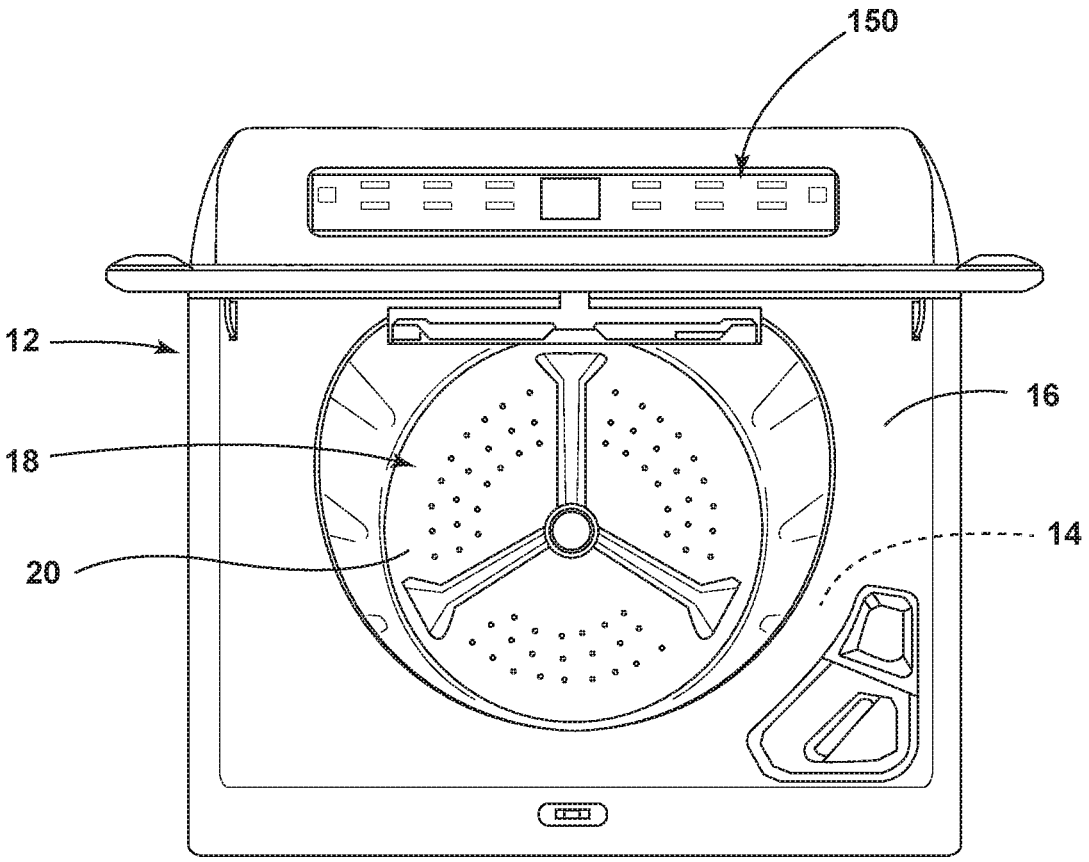
FIG. 2 is a top perspective view of a top-load laundry appliance that incorporates an aspect of the micro-particle filter.

The components in the figures are not necessarily to scale, emphasis instead being placed upon illustrating the principles described herein.

DETAILED DESCRIPTION

The present illustrated embodiments reside primarily in combinations of method steps and apparatus components related to a micro-particle filter for a laundry appliance that separates micro-sized particles from a process fluid and collects these micro-sized particles for later disposal and recycling. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-13, reference numeral 10 generally refers to a micro-particle filter that is incorporated within an appliance 12, typically a laundry appliance. The micro-particle filter 10 is utilized for capturing micro-sized particles 26 that can take the form of microfibers. These microfibers can be made of plastic or other similar polymer materials. In addition, these microfibers can be in the form of natural fibers that are coated with a plastic or polymer material. According to the various aspects of the device, a laundry appliance 12 includes a tub 14 that is positioned within an outer cabinet 16. A processing space 18 is defined within the tub 14, and typically within a drum 20 that rotationally operates within the tub 14. A fluid path 22 is positioned within the laundry appliance 12. The fluid path 22 operates to deliver a process fluid 24 through the tub 14 for treating articles 28 that are positioned within the processing space 18. A micro-particle filter 10 is positioned within the fluid path 22. The micro-particle filter 10 receives process fluid 24 via the fluid path 22 and separates micro-sized particles 26 from the process fluid 24. These micro-sized particles 26 can be released from the articles 28 being processed within the laundry appliance 12. In addition, these micro-sized particles 26 can be found within the process fluid 24 delivered from an external fluid source 30 for use within the laundry appliance 12. A secondary flow mechanism 32 operates to deliver the micro-sized particles 26 that are captured within the micro-particle filter 10 to a removable collection chamber 34.

Referring to FIGS. 1-4, the micro-particle filter 10 can be included within any one of various appliances 12. Such appliances 12 can include, but are not limited to, laundry washing appliances, laundry drying appliances, combination washing and drying laundry appliances, dishwashing appliances, water heaters, air conditioning systems, refrigerators, or other similar appliances that deliver fluid from one location to another. As the fluid moves through the appliance 12, the micro-particle filter 10 can be utilized for separating micro-sized particles 26 that may be present within the fluid being delivered within the appliance 12.

As discussed herein, micro-sized particles 26 can be removed from articles 28 being processed, such as within the laundry appliance 12. In addition, micro-sized particles 26, typically microfibers, can be found within external fluid sources 30. It has been found that microfibers and other micro-sized particles 26 have a size that can escape or pass through conventional filtration mechanisms. Accordingly, microfibers and other micro-sized particles 26 have been found within most any residential, commercial, or industrial fluid source 30.

Figure 3:
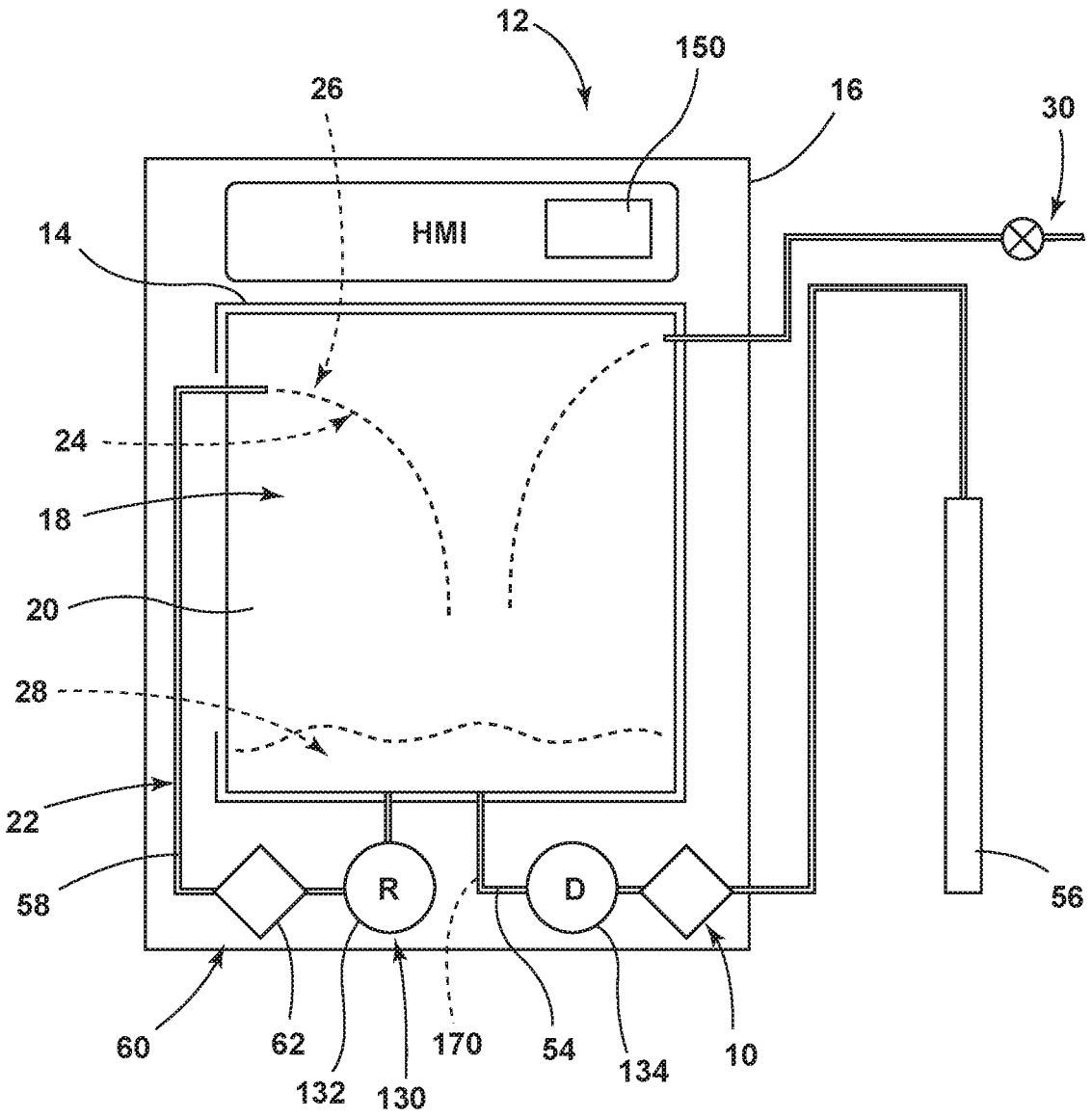
FIG. 3 is a schematic representation of a laundry appliance that includes a micro-particle filter positioned within a drain line for the laundry appliance.
Figure 4:
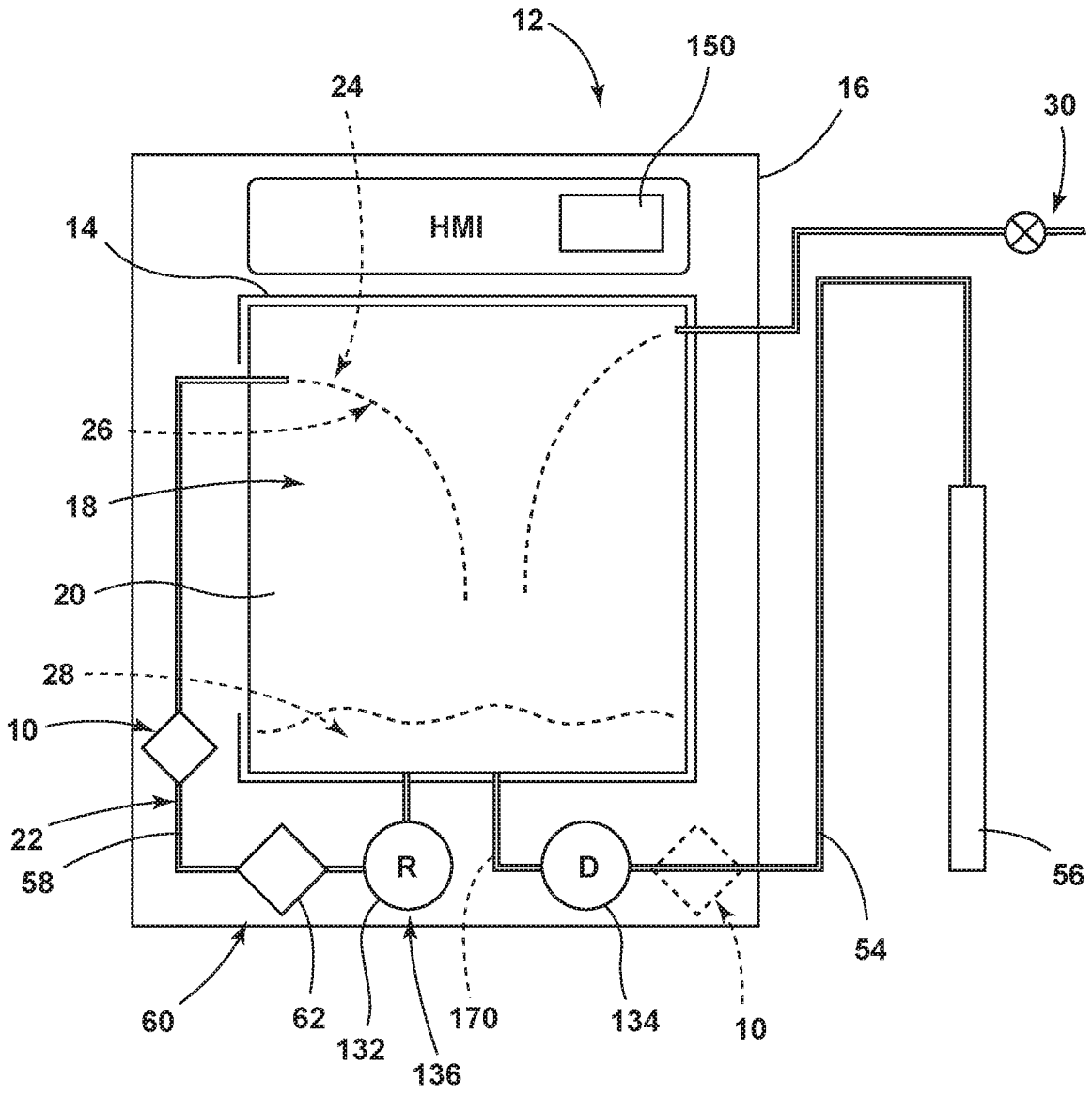
FIG. 4 is a schematic cross-sectional diagram of a laundry appliance that incorporates an aspect of the micro-particle filter within a recirculation line of the fluid system for the appliance.
Figure 5:
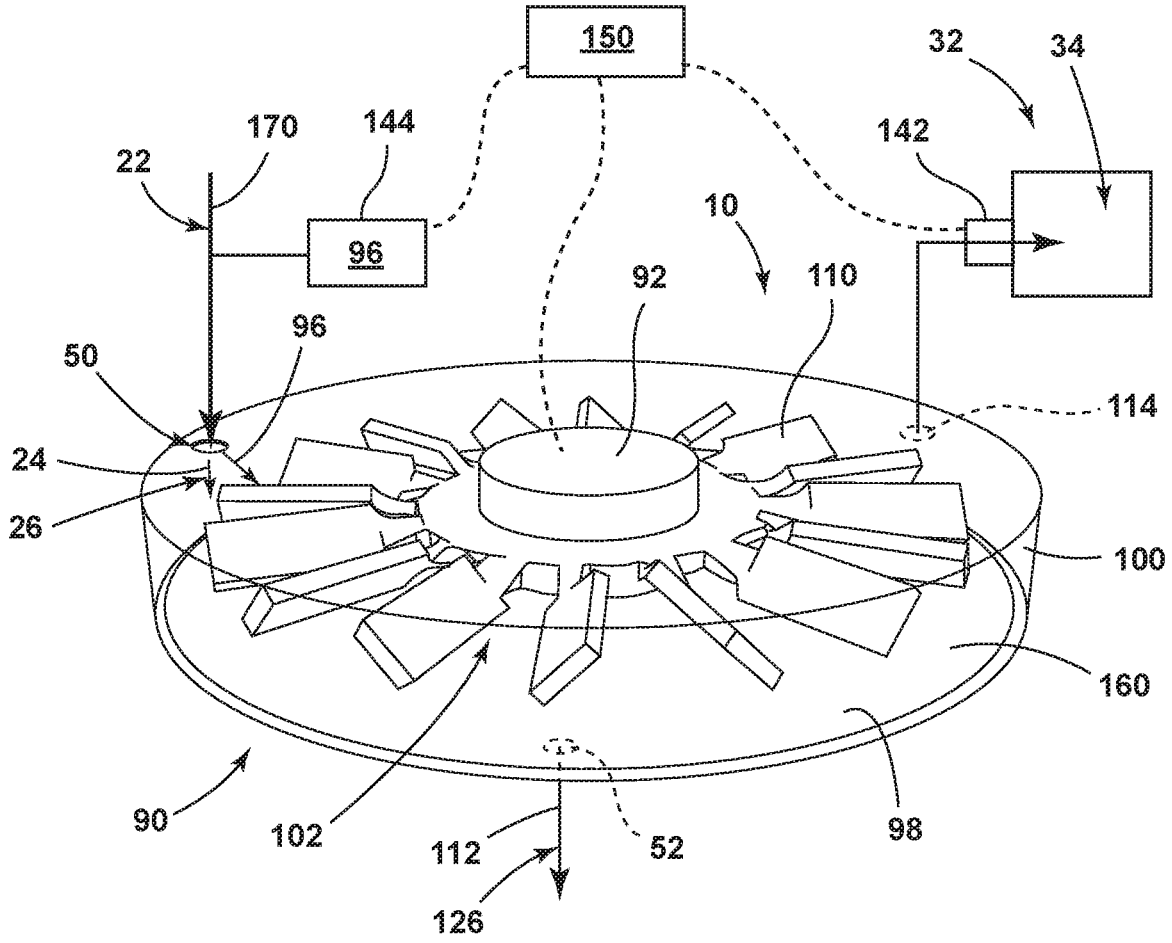
FIG. 5 is a schematic perspective view of an aspect of the micro-particle filter that incorporates a rotor for generating a centrifugal force and a hydrophobic material that collects micro-sized particles within a filtration chamber.
Figure 6:
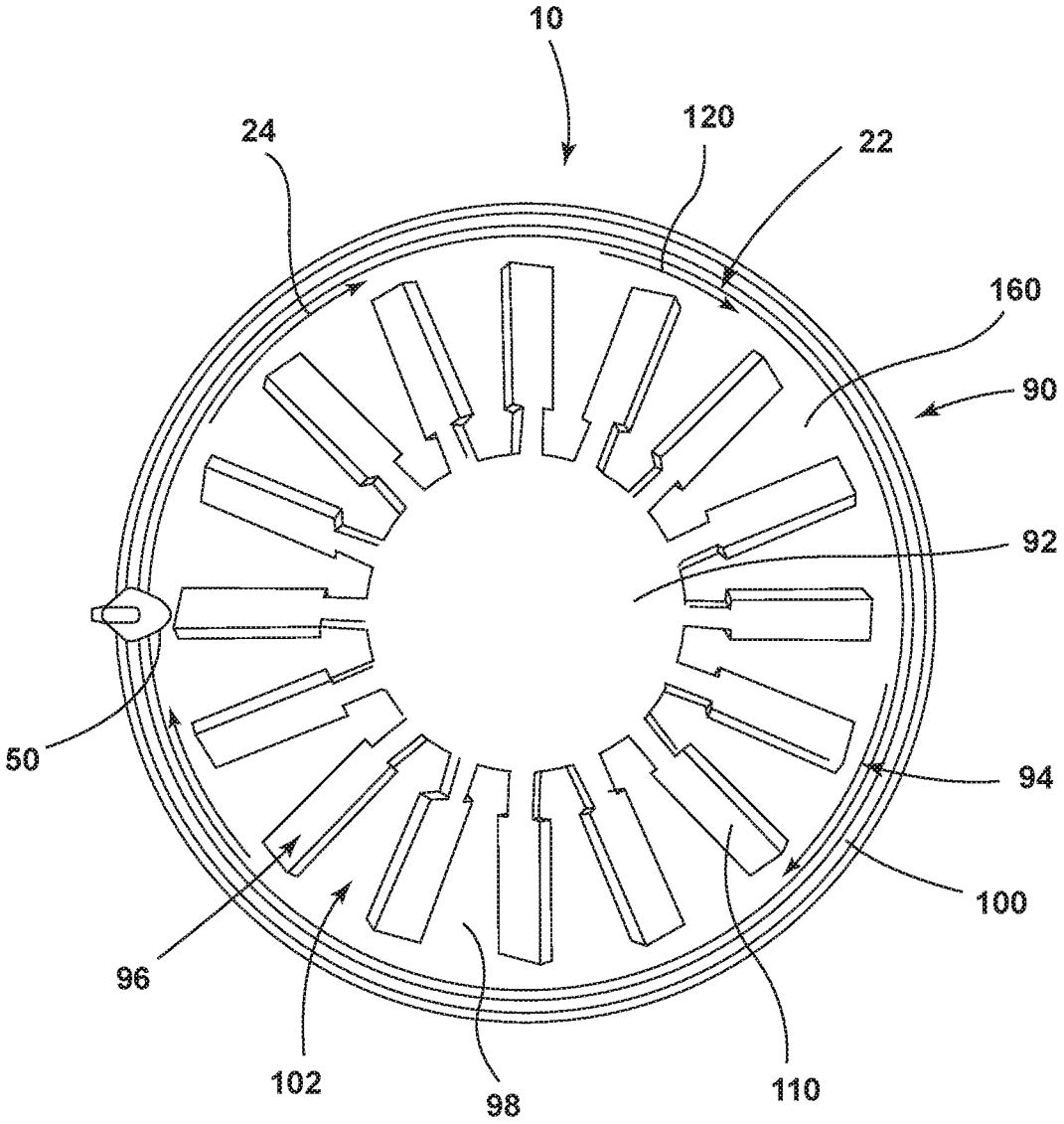
FIG. 6 is a top plan view of the micro-particle filter of FIG. 5.
Figure 7:
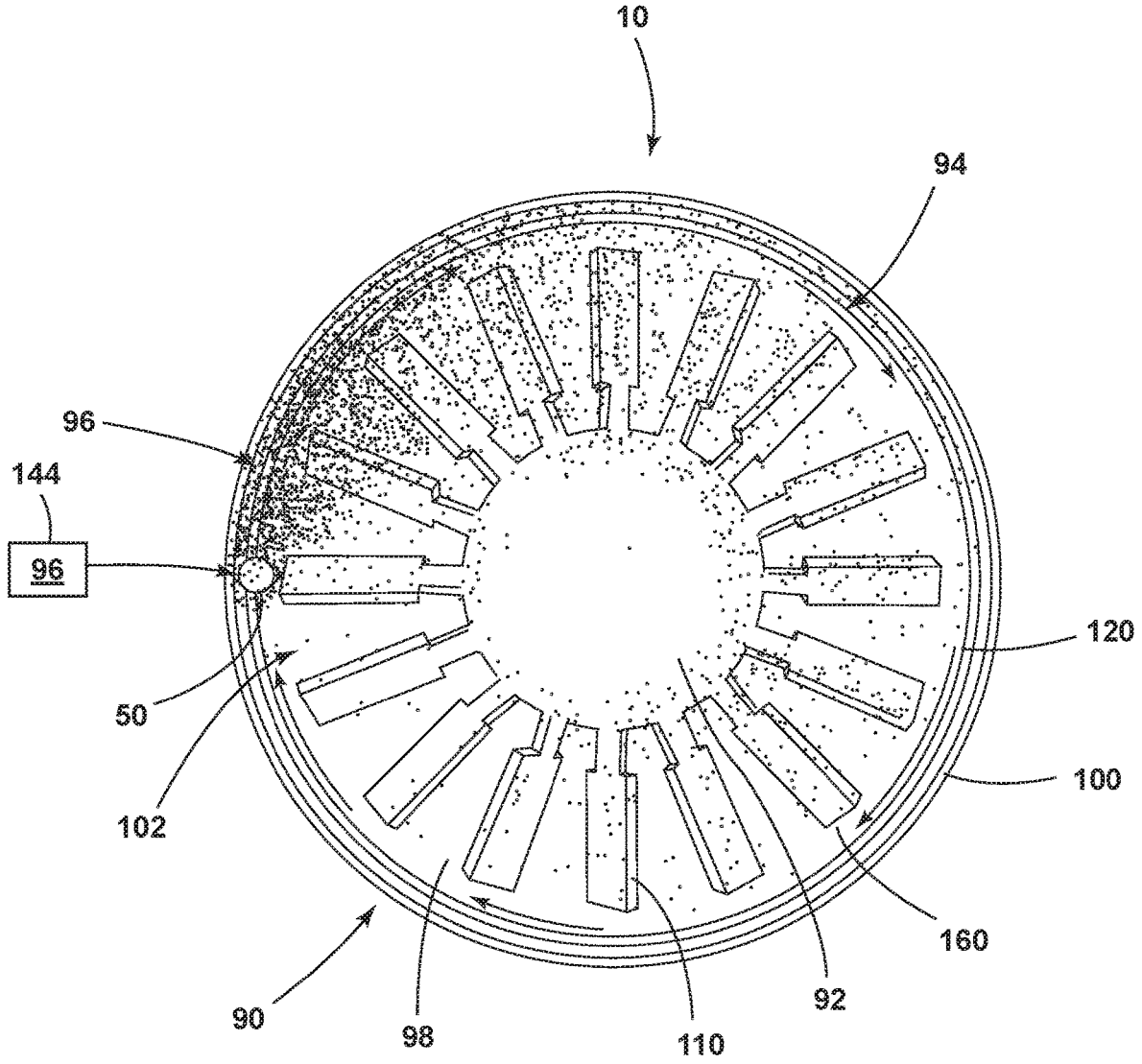
FIG. 7 is a schematic representation of the micro-particle filter of FIG. 6 and showing movement of micro-sized particles within a filtration chamber during operation of the rotor.
Figure 8:
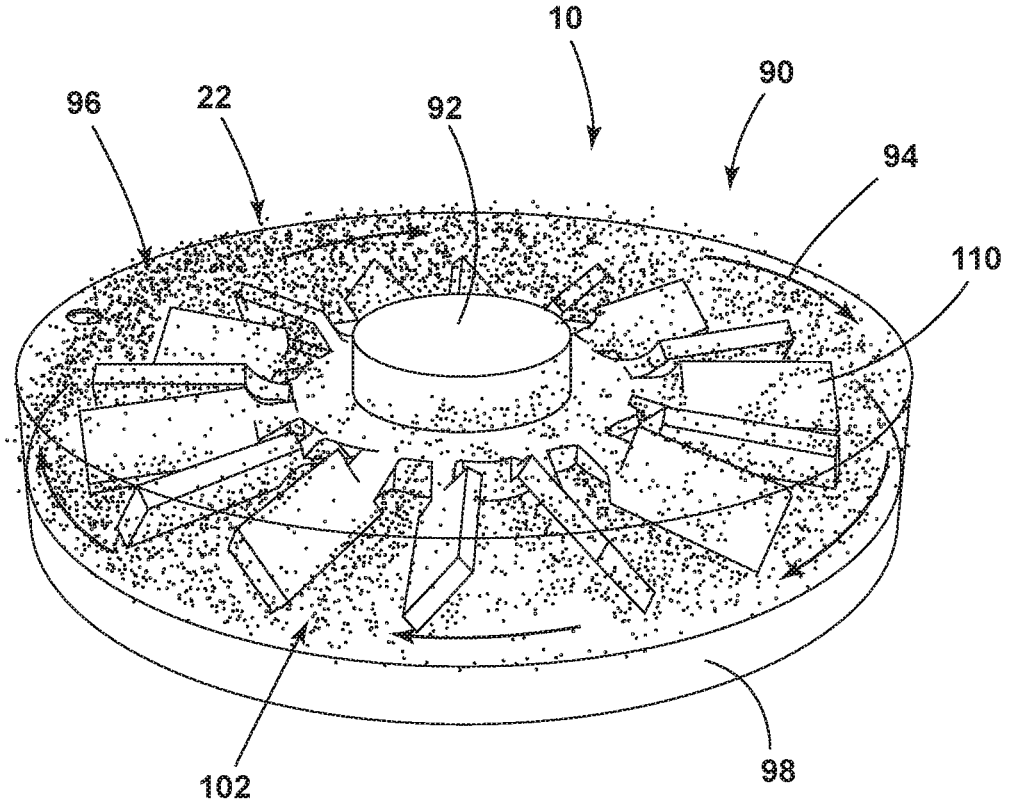
FIG. 8 is a schematic perspective view of the micro-particle filter of FIG. 7 showing movement of the micro-sized particles within a filtration chamber during operation of the rotor.
Figure 9:
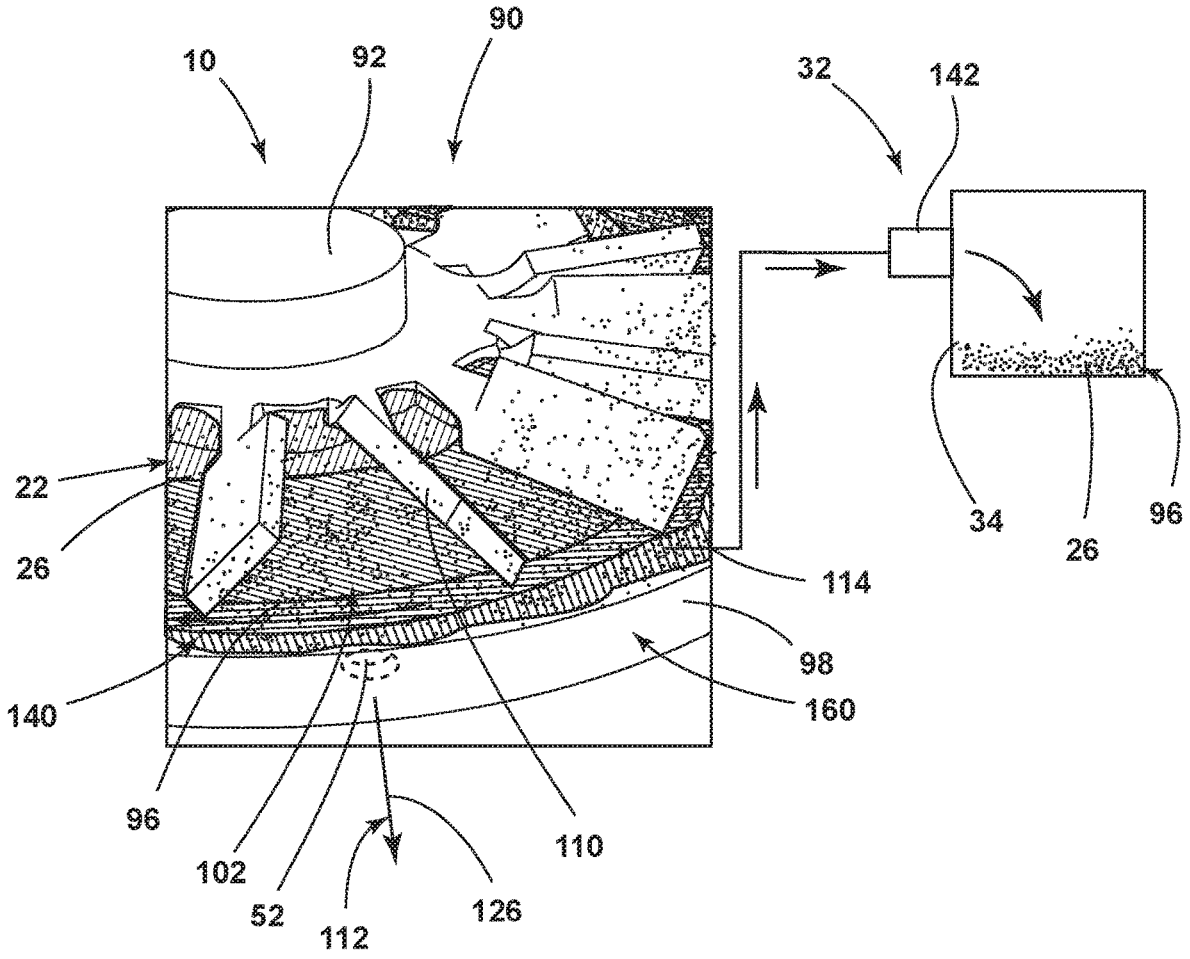
FIG. 9 is a schematic representation of the micro-particle filter of FIG. 8 and showing collection of the micro-sized particles within the hydrophobic material during operation of the rotor.

Referring now to FIGS. 3 and 4, laundry appliances 12 can include the fluid path 22 that delivers process fluid 24 to and from the processing space 18 during performance of various laundry cycles. The process fluid 24 typically includes water, detergent and other laundry chemistry, soil, larger particulate matter and lint, microfibers and other micro-sized particles 26, and other similar materials. The fluid path 22 can include a fluid inlet 50 that delivers process fluid 24 to the processing space 18, and a fluid outlet 52 that directs the process fluid 24 to a drain line 54. The drain line 54 is used to deliver used process fluid 24 from the processing space 18 to an external drain 56 or to a removable water bottle for disposal. In addition, as exemplified in FIGS. 3 and 4, the laundry appliance 12 can include the drain line 54 as well as a recirculation line 58. The drain line 54 operates to deliver process fluid 24 from the processing space 18 and to an external drain 56 or removable water bottle. This drain line 54 is typically used during the performance of a laundry cycle. Additionally or alternatively, the drain line 54 can be utilized at the conclusion of each laundry cycle. In addition, the laundry appliance 12 can include a recirculation line 58 that recirculates process fluid 24 from the processing space 18, through a filtration system 60 and then back to the processing space 18. Within each of the drain line 54 and the recirculation line 58, the filtration system 60 can include a primary filter 62 that separates larger particulate material, such as lint and foreign objects from the process fluid 24. The filtration system 60 can also include an aspect of the micro-particle filter 10 that can be used to separate and collect micro-sized particles 26 from the process fluid 24 before it is returned to the processing space 18 or delivered to the external drain 56 via the drain line 54.

Where the appliance 12 includes only the drain line 54, the filtration system 60 can include a primary filter 62 that is positioned upstream of a micro-particle filter 10 that are each positioned within the drain line 54. Where the appliance 12 includes each of the drain line 54 and the recirculation line 58, the filtration system 60 can be distributed through each of the drain line 54 and the recirculation line 58. In certain aspects of the device, each of the drain line 54 and the recirculation line 58 can include a dedicated primary filter 62 and a dedicated micro-particle filter 10. It is further contemplated that the recirculation line 58 will include only a primary filter 62 and the drain line 54 will include a micro-particle filter 10 that can be positioned downstream of a second primary filter 62 that is positioned within the drain line 54. Other configurations of the filtration system 60 and the primary filter 62 and the micro-particle filter 10 can also be utilized within various designs of appliances 12.

Referring now to FIGS. 5-11, the micro-particle filter 10 can include a dynamic filter 90 that includes a rotor 92 that generates a centrifugal flow 94 of process fluid 24. Typically, the process fluid 24 will include micro-sized particles 26 therein. As discussed herein, these micro-sized particles 26 can be separated from articles 28 being processed within the processing space 18 or can be present within fluid received from an external fluid source 30. The dynamic filter 90 also includes a hydrophobic material 96 that is disposed at least on a filter membrane 98. The filter membrane 98 and an outer wall 100 of the dynamic filter 90 define a dynamic filtration chamber 102 within which the rotor 92 operates to generate the centrifugal flow 94 of process fluid 24.

During operation of the rotor 92, micro-sized particles 26 are captured within the dynamic filtration chamber 102 and are collected therein to accumulate over time within the centrifugal flow 94. The hydrophobic material 96 that is disposed on the filter membrane 98 forms a slippery or low friction surface that maintains the circulating micro-sized particles 26 within the centrifugal flow 94 that is above or adjacent to the filter membrane 98 and the hydrophobic material 96. According to various aspects of the device, the hydrophobic material 96 can be located on the filter membrane 98 as well as on the rotor 92, such as on the blades 110 of the rotor 92. The hydrophobic material 96 tends to prevent absorption of a liquid component 112 of the process fluid 24. This characteristic of the hydrophobic material 96, at the same time, promotes the collection of the micro-sized particles 26 within the dynamic filtration chamber 102.

Figure 11:
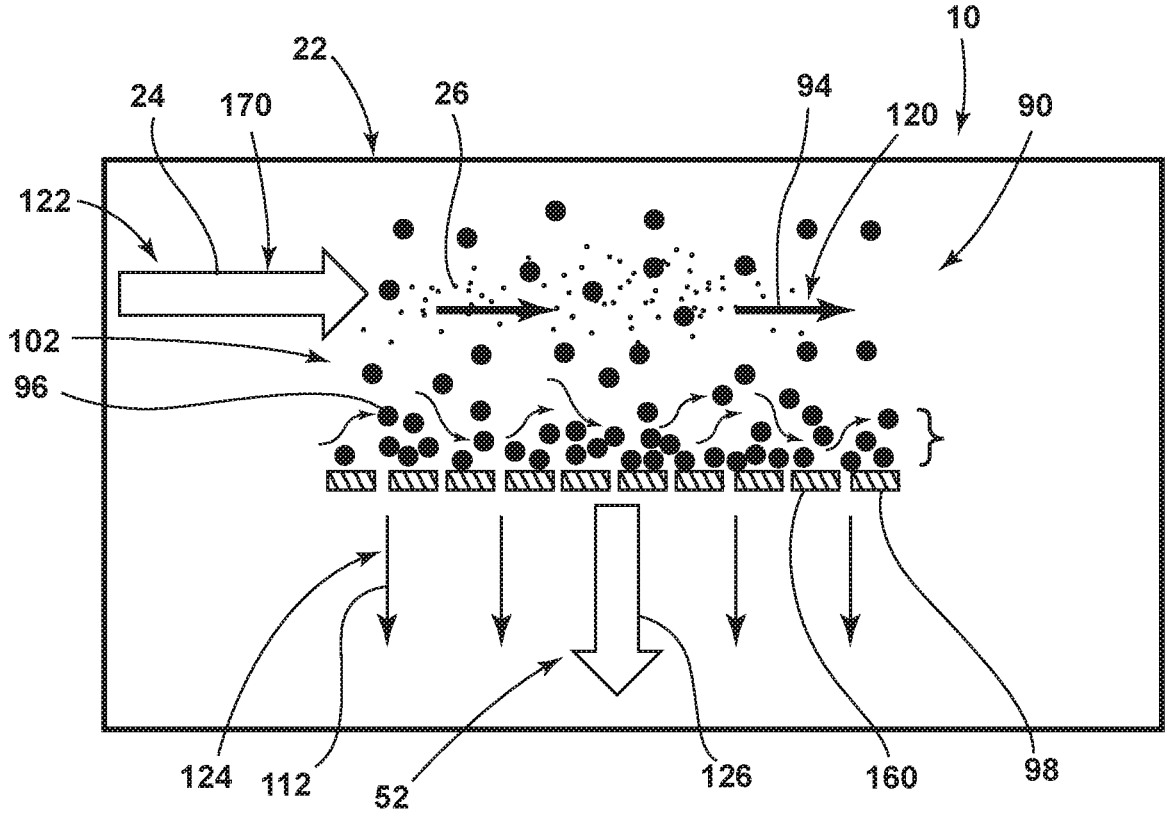
FIG. 11 is a schematic representation of the micro-fiber filter of FIG. 8 showing the centrifugal flow of process fluid during operation of the rotor as well as collection of the micro-sized particles within the hydrophobic material and permeation of the now-filtered process fluid through the filter membrane.

Referring now to FIG. 11, during operation of the rotor 92, the blades 110 of the rotor 92 generate the centrifugal flow 94 of the process fluid 24 within the dynamic filtration chamber 102. This centrifugal flow 94 moves the process fluid 24 in a generally parallel direction 120 with respect to the filter membrane 98. The micro-sized particles 26 are also moved within this centrifugal flow 94 within the dynamic filtration chamber 102 in the direction parallel with the filter membrane 98. The hydrophobic material 96 has a low flow resistance which provides for a continual movement of the micro-sized particles 26 within the dynamic filtration chamber 102 that is positioned above or adjacent to the filter membrane 98. As the process fluid 24 is continuously delivered into the dynamic filter 90, a fluid pressure 122 within the dynamic filtration chamber 102 increases. Because the liquid component 112 of the process fluid 24 is generally non-compressible or only minimally compressible, the liquid component 112 of the process fluid 24 is able to move in a generally perpendicular direction 124. This allows the liquid component 112 of the process fluid 24 to move through and permeate the filter membrane 98 resulting in filtered process fluid 126 that can be delivered to an external outlet or recirculated back to the processing space 18.

Referring again to FIGS. 3-11, the increased fluid pressure 122 that is generated within the dynamic filter 90 can be generated through operation of a fluid pump 130 such as a recirculation pump 132, a drain pump 134 or a combination recirculation and drain pump. In this manner, the fluid pump 130 can be used to direct the process fluid 24 through the fluid path 22. In certain aspects of the device, movement of the rotor 92 can also be used to generate this fluid pressure 122. Where the blades 110 of the rotor 92 are used to at least partially generate the fluid pressure 122 in the dynamic filter 90, the slope or orientation of the blades 110 can be used to promote the centrifugal movement of the process fluid 24 having the micro-sized particles 26 as well as the generally perpendicular movement of the liquid component 112 of the process fluid 24 through the filter membrane 98 and the hydrophobic material 96.

Referring again to FIG. 11, the micro-sized particles 26 typically have a lesser density than the liquid component 112 of the process fluid 24 and tend to be buoyant within the process fluid 24. This characteristic of the micro-sized particles 26 tends to maintain this material of the process fluid 24 within the centrifugal flow 94 adjacent to and above the filter membrane 98 and the hydrophobic material 96. During the performance of a laundry cycle for the laundry appliance 12, the rotor 92 continuously operates to maintain the centrifugal flow 94 of process fluid 24 within the dynamic filtration chamber 102. Accordingly, this centrifugal flow 94 maintains the micro-sized particles 26 in a state of continuous centrifugal movement in the parallel direction 120 above the filter membrane 98.

According to various aspects of the device, the rotor 92 can rotate about a rotational axis at various speeds. Typically, the rotor 92 can operate at speeds of approximately 1,000 revolutions per minute. It should be understood that other rotational speeds are contemplated. It has been found that an increase in the rotational speed of the rotor 92 provides for increased efficiency in filtering the process fluid 24 and separating the micro-sized particles 26 from the process fluid 24. As the rotor 92 operates at a faster rotational speed, the centrifugal force that generates the centrifugal flow 94 of process fluid 24 increases. The increased force of the centrifugal flow 94 provides a greater resistance to the micro-sized particles 26 permeating the hydrophobic material 96 and the filter membrane 98. Stated another way, an increase in the centrifugal flow 94 causes the micro-sized particles 26 to move faster relative to the hydrophobic material 96 and the filter membrane 98. In this manner, the micro-sized particles 26 merely skip off of the hydrophobic material 96 and the filter membrane 98 and remain within the upper portion of the dynamic filter 90 above the filter membrane 98. Where greater amounts of process fluid 24 are moved through the dynamic filter 90, the micro-sized particles 26 are prevented from passing through the hydrophobic material 96 and the filter membrane 98. Conversely, greater amounts of the liquid component 112 of the process fluid 24 can move therethrough. Accordingly, significant amounts of process fluid 24 can be filtered utilizing the dynamic filter 90 during operation of the laundry appliance 12. This allows for the filtration of process fluid 24 to separate micro-sized particles 26 without diminishing the performance of the appliance 12.

Referring again to FIGS. 5-11, the liquid component 112 of the process fluid 24 is not typically subject to compression. In addition, the micro-sized particles 26 have a very minimal weight and tend to float or tend to have a density less than that of the liquid component 112 of the process fluid 24. Accordingly, the centrifugal flow 94 of process fluid 24 that is generated through operation of the rotor 92 maintains the micro-sized particles 26 within the dynamic filtration chamber 102 above the filter membrane 98. At the same time, as additional amounts of process fluid 24 are introduced to the dynamic filter 90, the fluid pressure 122 within the dynamic filtration chamber 102 increases. This increase in fluid pressure 122 results in the movement of the liquid component 112 of process fluid 24 in a perpendicular direction 124 from the dynamic filtration chamber 102, through the hydrophobic material 96 and the filter membrane 98, and to downstream portions of the fluid path 22.

Figure 10:
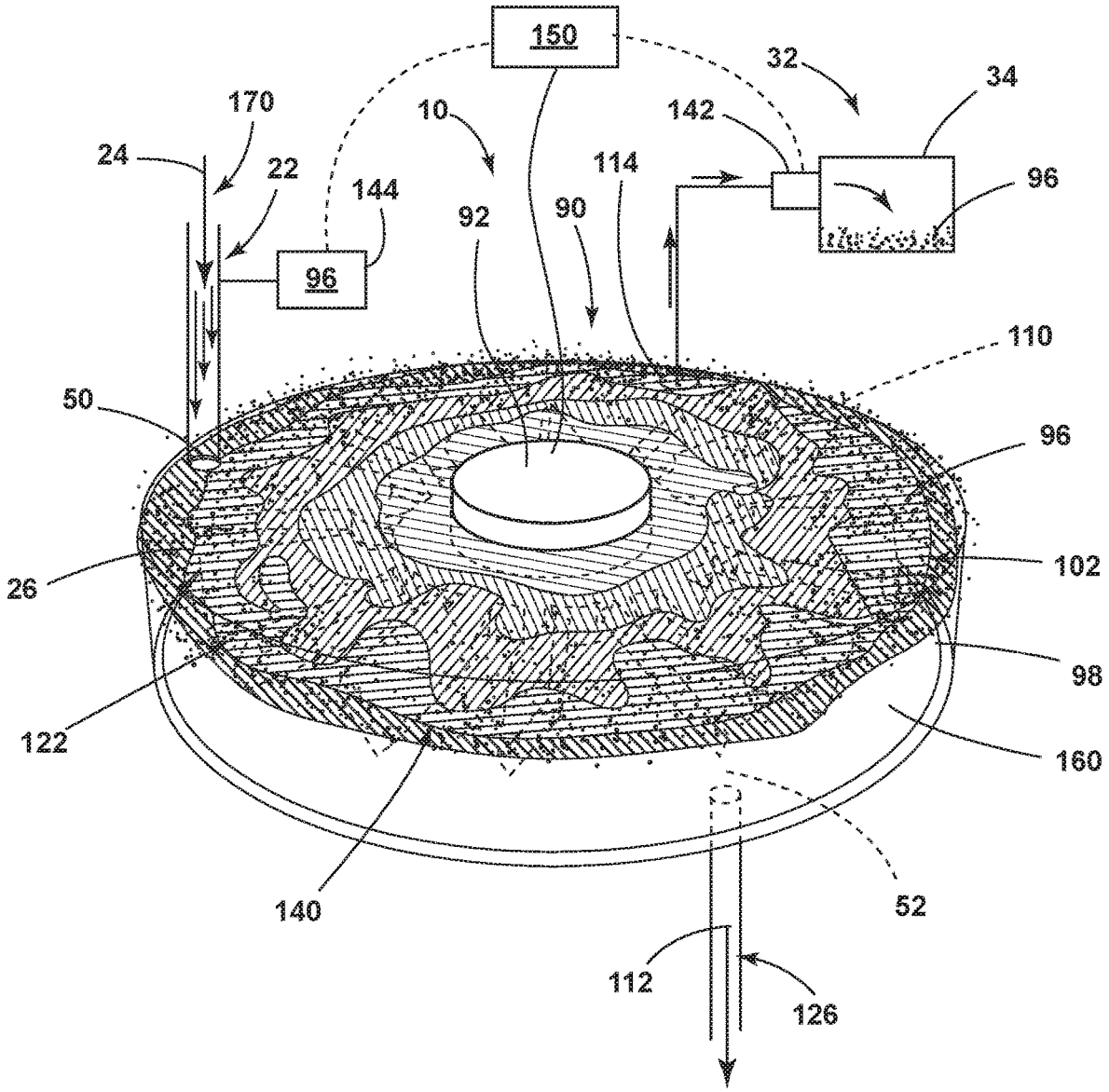
FIG. 10 is a schematic diagram illustrating collection of the micro-sized particles within the hydrophobic material that accumulates within the filtration chamber during operation of the rotor.

As exemplified in FIG. 10, at the conclusion of a laundry cycle, the rotor 92 can slow or stop rotation. As this occurs or after the rotor 92 stops, the micro-sized particles 26 tend to rest on the surface of the hydrophobic material 96. This accumulation of the micro-sized particles 26 on the hydrophobic material 96 forms a cake 140 that is composed of the hydrophobic material 96 and the accumulated micro-sized particles 26. At this point, the hydrophobic material 96, along with the micro-sized particles 26, can be suctioned out of the dynamic filtration chamber 102 using a suction mechanism 142. Using the suction mechanism 142, the hydrophobic material 96 and the captured micro-sized particles 26 are delivered to the removable collection chamber 34.

After the micro-sized particles 26 are suctioned to the removable collection chamber 34, a dispensing mechanism 144 can dispose a new layer of hydrophobic material 96 onto at least the filter membrane 98. The hydrophobic material 96, as discussed herein, can also be placed on the rotor 92, in particular on the blades 110 of the rotor 92. The hydrophobic material 96 can be disposed into the dynamic filtration chamber 102 via the fluid inlet 50. Operation of the rotor 92 can operate to disperse and distribute the hydrophobic material 96 onto the filter membrane 98 and onto the blades 110 of the rotor 92. The use of the hydrophobic material 96 prevents saturation of this material during rotation of the rotor 92. At the same time, the liquid component 112 of the process fluid 24 is repelled and delivered through the filter membrane 98. Contemporaneously, the micro-sized particles 26 are maintained within the dynamic filtration chamber 102 positioned above the filter membrane 98.

The hydrophobic material 96 can be in the form of a gel or other biomaterial that is disposed on the filter membrane 98 and the blades 110 of the rotor 92. This material can include any one of various hydrophobic materials 96. These materials can include, but are not limited to, biomaterials, lysozyme crystals, combinations thereof, and other similar hydrophobic materials 96. The filter membrane 98 can include various filtration structures, and include materials such as carbon nanotubes 160, micro-sized mesh, nano-sized mesh, combinations thereof, and other similar filtration structures. In various aspects of the device, the filter membrane 98 can be made of carbon nanotubes 160 that are positioned in one of a single wall configuration, a double-wall configuration or other multi-wall configuration.

According to various aspects of the device, studies have shown that higher levels of turbidity or higher concentrations of micro-sized particles 26, such as microfibers, within the process fluid 24 has produced a greater efficiency in the filtration of the process fluid 24. Higher influent flux within the process fluid 24 facilitated rapid formation of a dynamic layer on top of the filter membrane 98. This dynamic layer is typically in the form of the cake 140 that is composed of the hydrophobic material 96 and the accumulated micro-sized particles 26. Stated another way, the accumulation of micro-sized particles 26 within the centrifugal flow 94 increases the filtering capability of the dynamic filter 90. Greater concentrations of the micro-sized particles 26, in turn, causes an increased filtering capability within the dynamic filtration chamber 102. The formation process of this dynamic membrane can be effected by the influent particle concentration. Higher influent concentrations of the micro-sized particles 26 can result in more micro-sized particles 26 being filtered by a supporting mesh, typically formed by carbon nanotubes, thereby laying the foundation for the rapid formation of the dynamic membrane and faster effluent reduction in the turbidity of the process fluid 24. Accordingly, the formation of this dynamic membrane forms, and increases, a physical barrier which ultimately forms thicker and thicker layers of the hydrophobic material 96 and micro-sized particles 26. These results have also been seen at higher fluid levels and higher volumes of process fluid 24 being moved through the dynamic filter 90.

As exemplified in FIGS. 5-9, the micro-particle filter 10 having the dynamic filter 90 can include a fluid inlet 50 through which process fluid 24 can be delivered. It is contemplated that the hydrophobic material 96 can also be delivered into the dynamic filter 90 through this fluid inlet 50. The suction mechanism 142 can also operate through the fluid inlet 50. In such an aspect of the device, the dynamic filter 90 includes only one fluid inlet 50 that is upstream of the filter membrane 98 and one fluid outlet 52 that is downstream of the filter membrane 98. In certain aspects of the device, the suction mechanism 142 can operate through a separate suctioning outlet 114 to remove the used hydrophobic material 96 that includes the captured micro-sized particles 26.

According to various aspects of the device, because of the increased efficiency of the appliance 12 at higher turbidity levels or higher concentrations of micro-sized particles 26, the micro-particle filter 10 having the dynamic filtration chamber 102 can be used effectively in each of the drain line 54 and the recirculation line 58 of the fluid path 22. It is contemplated that each of the drain line 54 and the recirculation line 58 can include a dedicated micro-particle filter 10. Alternatively, the micro-particle filter 10 can be located in the drain line 54 or the recirculation line 58 only.

Referring again to FIGS. 5-11, the dynamic filter 90 is positioned within the fluid path 22 for the laundry appliance 12. As discussed herein, the dynamic filter 90 includes the rotor 92 having the plurality of blades 110 that rotate within the dynamic filtration chamber 102. The rotor 92 operates to circulate the process fluid 24 having the micro-sized particles 26 contained therein, sometimes referred to as greywater 170, to form the centrifugal flow 94 above and parallel with the filter membrane 98. This centrifugal flow 94 of the greywater 170 captures the micro-sized particles 26 within the centrifugal flow 94. At the same time, the increased fluid pressure 122 within the dynamic filtration chamber 102 allows filtered process fluid 126 to pass through the hydrophobic material 96 and the filter membrane 98. Over time, the micro-sized particles 26 and the hydrophobic material 96 form the cake 140 that is positioned above the filter membrane 98. The fluid pressure 122 that is delivered to the dynamic filtration chamber 102 can be generated through operation of a fluid pump 130 for the fluid path 22. In certain aspects of the device, the dynamic filter 90 can include a dedicated fluid pump 130 that maintains a consistent fluid pressure 122 of the process fluid 24 or greywater 170 within the dynamic filter 90. The centrifugal flow 94 of the process fluid 24 prevents the accumulation of micro-sized particles 26 on or directly upon the surface of the filter membrane 98. Alternatively, the filtered process fluid 126 is able to permeate the filter membrane 98 and the hydrophobic material 96 and reenter the fluid path 22 for delivery to the external drain 56 or back to the processing space 18.

Referring again to FIGS. 1-11, a controller 150 for the dynamic filter 90 or for the laundry appliance 12 operates to maintain a proportional balance between a rotational speed of the rotor 92, a dispensing action of the hydrophobic material 96 from the dispensing mechanism 144 at the beginning of each laundry cycle and the flow rate of greywater 170 that is moved from the fluid path 22 and into the filtration chamber 192. This balance helps to maintain a particular centrifugal flow 94 that is able to capture and retain the micro-sized particles 26 within this centrifugal flow 94. As discussed herein, maintaining the micro-sized particles 26 within the centrifugal flow 94 prevents deposition of the micro-sized particles 26 onto and through the filter membrane 98 and also allows the filtered process fluid 126 to pass through the filter membrane 98 and move along the fluid path 22 for later use, delivery through the recirculation line 58 or disposal via the drain line 54. Additionally, the controller 150 can operate to provide for the consistent accumulation of the micro-sized particles 26 that provides the increased filtering capability of the filter membrane 98 and the hydrophobic material 96.

According to various aspects of the device as discussed herein, the removable collection chamber 34 can be removed from the appliance 12 periodically and after a certain extended period of time. Typically, the removable collection chamber 34 will be removed and emptied approximately once every several weeks, approximately once every few months, approximately once every year, approximately once every two to three years or other approximate timeframe. Typically, the removable collection chamber 34 will be emptied by a service technician that is called to maintain the laundry appliance 12 over regular intervals. During a service call, the removable collection chamber 34 can be separated from the fluid path 22 and from a dynamic filter 90 and can be emptied or replaced so that the micro-sized particles 26 can be recycled or responsibly disposed of. Because the removable collection chamber 34 is only periodically maintained, it is typical that the removable filtration chamber 192 may not be externally accessible via the outer cabinet 16 of the appliance 12. Accordingly, a service technician may be able to open the outer cabinet 16 to access the removable filtration chamber 192 to dispose of the captured micro-sized particles 26.

Referring now to FIGS. 1-4, 12 and 13, the laundry appliance 12 can include the tub 14 that is positioned within the outer cabinet 16, wherein the processing space 18 is defined within the tub 14. The fluid path 22 delivers process fluid 24 through the tub 14 for treating articles 28 within the processing space 18. A micro-particle filter 10 is positioned within the fluid path 22. The micro-particle filter 10 separates micro-sized particles 26 from the process fluid 24. A secondary flow mechanism 32 delivers the micro-sized particles 26 from the micro-particle filter 10 to a removable collection chamber 34. The secondary flow mechanism 32 can be in the form of a backflow reservoir 190 that is used to flush micro-sized particles 26 from a filter membrane 98 within the micro-particle filter 10. These micro-sized particles 26 can be delivered to the removable collection chamber 34.

Referring again to FIGS. 12 and 13, the micro-particle filter 10 can be in the form of a carbon nanotube membrane that is positioned within a filtration chamber 192. The filtration chamber 192 can be coupled with a fluid inlet 50 that allows for entry of process fluid 24 having micro-sized particles 26 contained therein. As the process fluid 24 passes through the filter membrane 98, the micro-sized particles 26 are captured within the leading surface 194 of the filter membrane 98. The carbon nanotube structure that forms the filter membrane 98 forms a mesh size that is able to capture micro-sized particles 26 therein. After the process fluid 24 is filtered using the filter membrane 98, the now filtered process fluid 126 can exit through a fluid outlet 52.

Referring again to FIGS. 12 and 13, the micro-particle filter 10 can include a plurality of valves that are positioned within a fluid inlet 50, a fluid outlet 52 and a collector outlet 216. During a filtration phase of the laundry cycle, a first valve 210 and a second valve 212 that are positioned at the fluid inlet 50 and the fluid outlet 52, respectively, are opened to allow for movement of the process fluid 24 into the filtration chamber 192, through the filter membrane 98, and through the fluid outlet 52. The third valve 214 that is positioned at the collector outlet 216. The first and third valves 210, 214 are each operable between open and closed positions 224, 226. The second valve 212 is operable, in combination with the first and third valves 210, 214, to define a filtering position 218 and a collection position 220.

Figure 12:
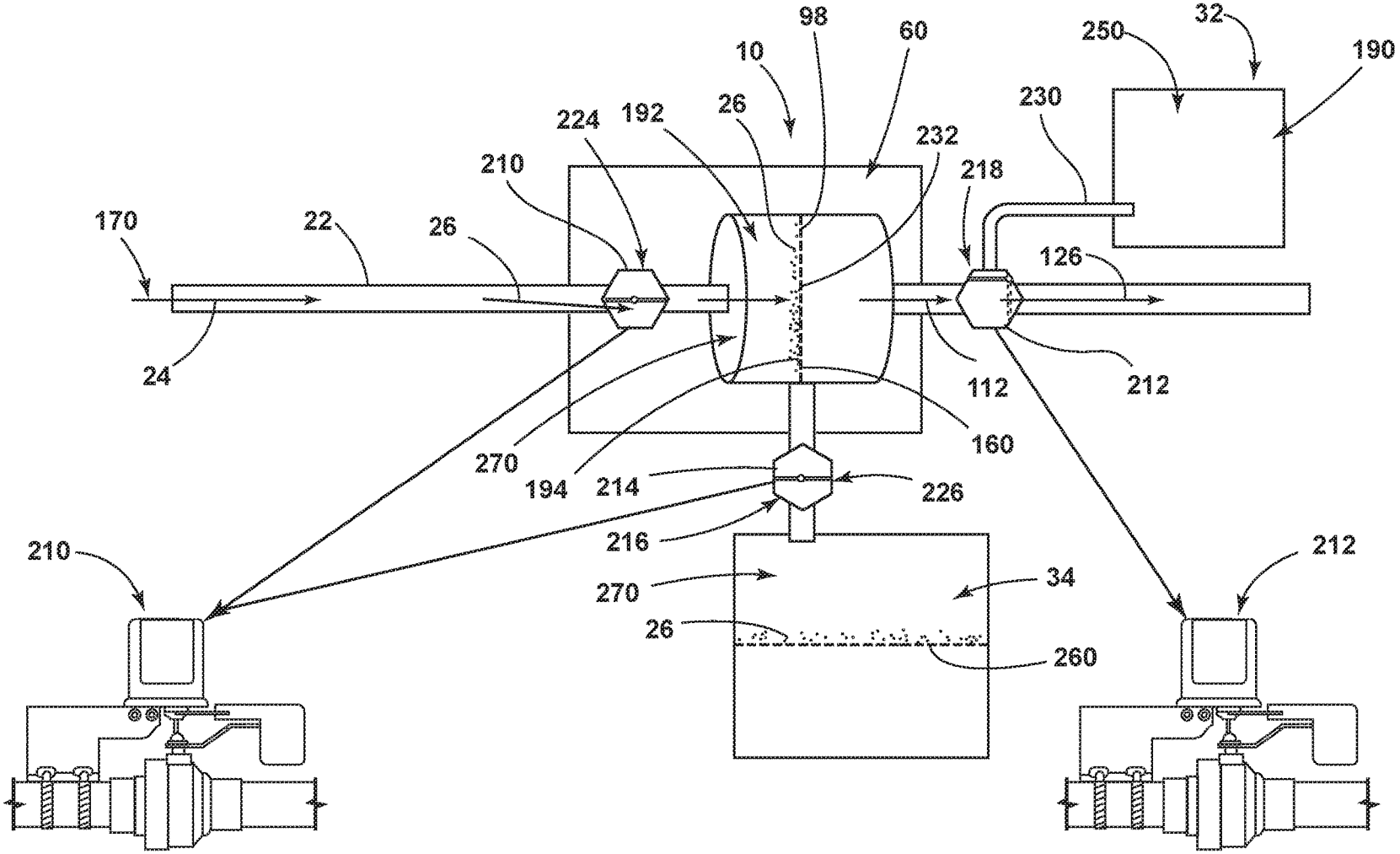
FIG. 12 is a schematic diagram illustrating an aspect of the micro-particle filter that includes a backflow reservoir and a valve system in a filtering position for separating micro-sized particles from process fluid.

As exemplified in FIG. 12, which illustrates an aspect of the filtering position 218, the third valve 214 can remain in a closed position 226 to prevent infiltration of unfiltered process fluid 24 into the collection chamber 34. In this filtering position 218, the third valve 214 is in the closed position 226. The positions of the first, second and third valves 210, 212, 214 allows for the movement of greywater 170 through the filter membrane 98 so that the micro-sized particles 26 can be separated and the filtered process fluid 126 can be delivered to the fluid outlet 52.

Figure 13:
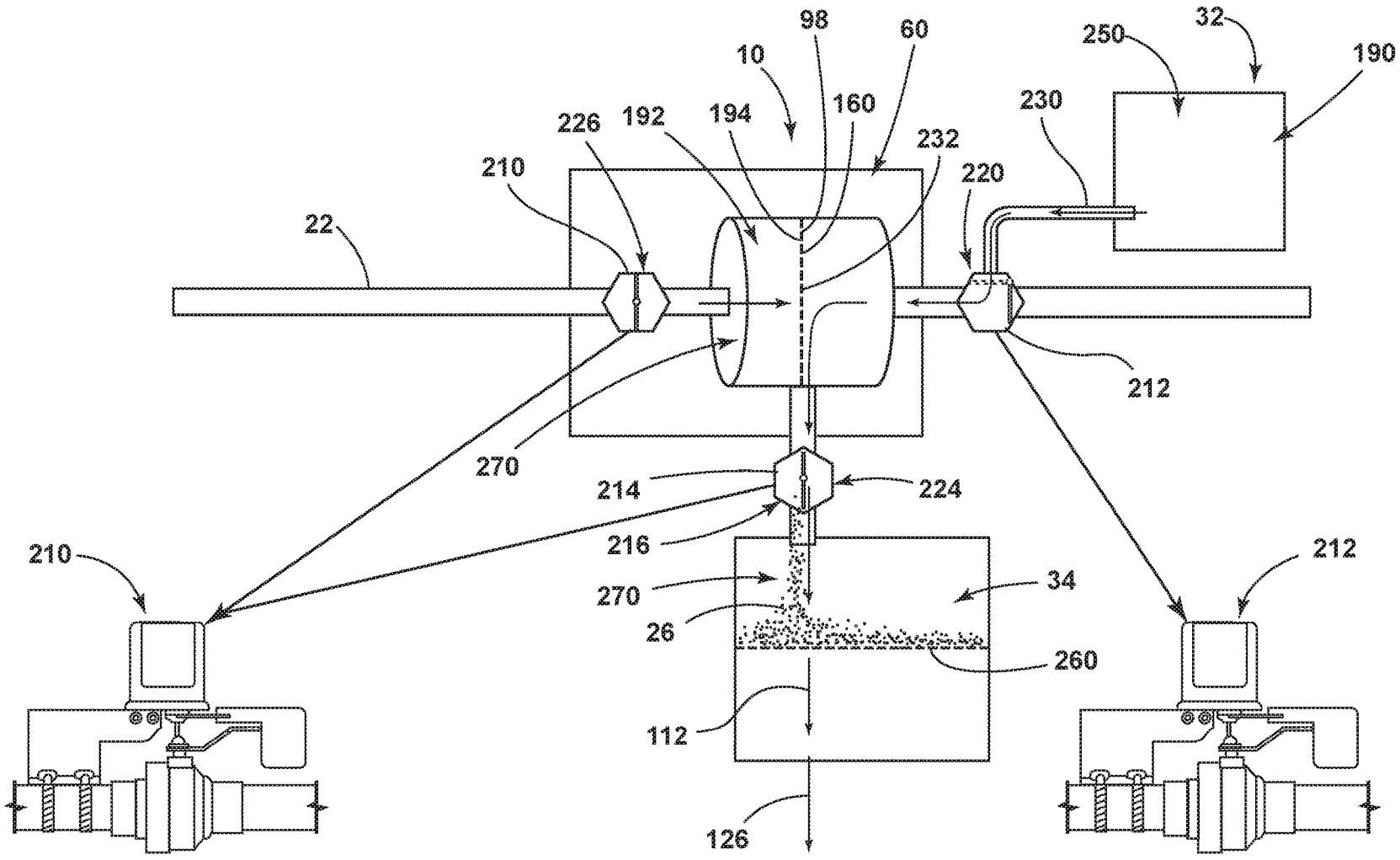
FIG. 13 is a schematic diagram of the micro-particle filter of FIG. 12 showing the valve system in a collection position for moving captured micro-sized particles to a removable collection chamber.
Figure 14:
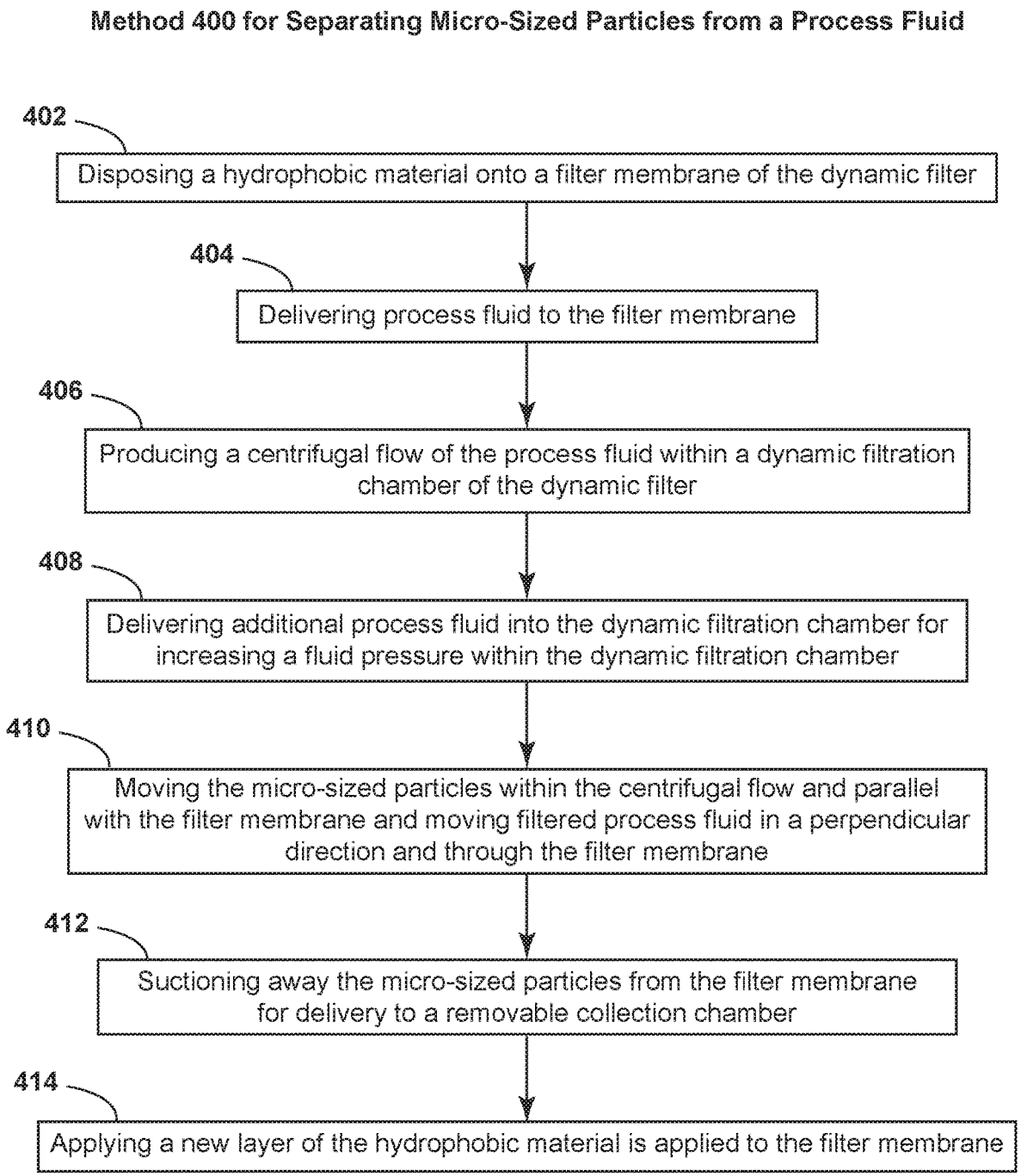
FIG. 14 is a schematic flow diagram illustrating a method for filtering and capturing micro-sized particles using a micro-particle filter.
Figure 15:
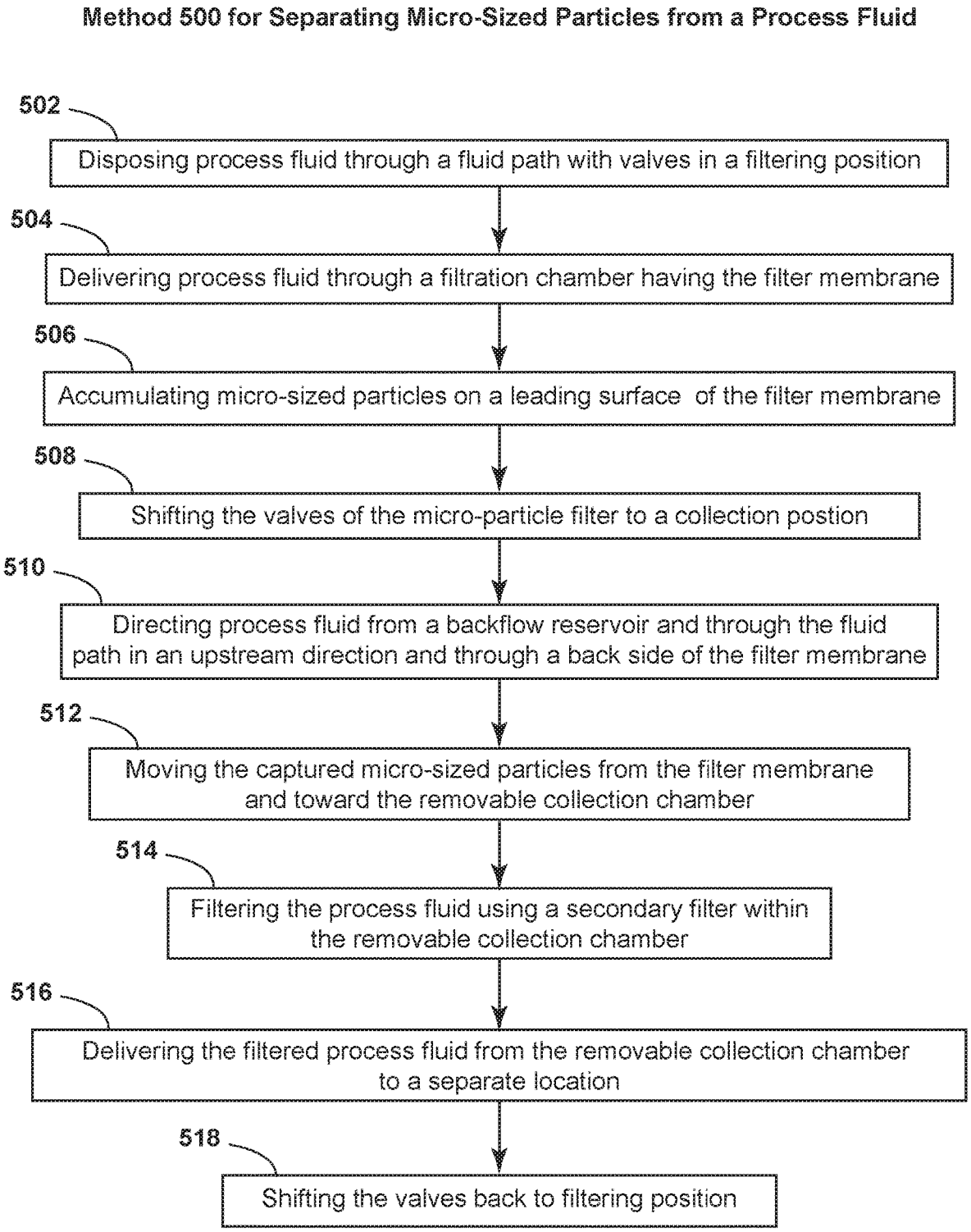
FIG. 15 is a schematic flow diagram illustrating a method for filtering and capturing micro-sized particles using a micro-particle filter.

Referring now to FIG. 13, which illustrates an aspect of the collection position 220, at the conclusion of a particular laundry cycle, or within a particular intermediary portion of the laundry cycle, the first valve 210 at the fluid inlet 50 can move to a closed position 226 and the third valve 214 at the collector outlet 216 can be moved to an open position 224. The second valve 212 at the fluid outlet 52 can be modified to the collection position 220 to open a backflow passage 230 from a backflow reservoir 190 of the micro-particle filter 10. When the second valve 212 is moved to define the collection position 220, process fluid 24, typically filtered process fluid 126, from the backflow reservoir 190 is moved through the backflow passage 230 and into the fluid path 22, in a reverse or upstream direction 240, and through a back side 232 of the filter membrane 98. This reverse movement of the process fluid 24 in the upstream direction 240 pushes the captured micro-sized particles 26 from the leading surface 194 of the filter membrane 98 and through the now-opened third valve 214 and the collector outlet 216 that leads into the removable collection chamber 34. Typically, the collector outlet 216 that leads to the removable collection chamber 34 will be upstream of the filter membrane 98 so that process fluid 24 moving from the backflow reservoir 190 can push the captured micro-sized particles 26 off from the leading surface 194 of the filter membrane 98 and in the upstream direction 240 toward the collector outlet 216 for the removable collection chamber 34.

After movement of the process fluid 24 from the backflow reservoir 190 is complete, the third valve 214 is moved to the closed position 226 to prevent infiltration of additional and unfiltered process fluid 24 into the removable collection chamber 34. The first valve 210 is moved to the open position 224 and the second valve 212 is modified to the filtering position 218 that closes off the backflow passage 230 and the backflow reservoir 190. This positioning of the first, second and third valves 210, 212, 214 to the filtering position 218 again allows for the flow of process fluid 24 through the fluid inlet 50, through the filter membrane 98 and out of the filtration chamber 192 through the fluid outlet 52.

The second valve 212 is moved from the collection position 220 to the filtering position 218 to prevent movement of process fluid 24 away from the backflow reservoir 190. At this stage, process fluid 24 can be delivered to the backflow reservoir 190 to prepare the backflow reservoir 190 for the next filter-cleaning stage of the laundry cycle. The backflow reservoir 190 can be maintained at a positive pressure 250 so that when the second valve 212 is moved to the collection position 220, the positive pressure 250 within the backflow reservoir 190 causes the process fluid 24 to flow in the upstream direction 240 and towards the back side 232 of the filter membrane 98. It is also contemplated that a separate backflow pump chamber can be positioned proximate the backflow reservoir 190 to provide the positive pressure 250 for moving process fluid 24 from the backflow reservoir 190 to the removable collection chamber 34.

Referring again to FIGS. 12 and 13, the removable collection chamber 34 can include a secondary filter 260 in the form of a hydrogel filter that maintains the captured micro-sized particles 26 within the removable collection chamber 34. After the process fluid 24 from the backflow reservoir 190 moves through the removable collection chamber 34, it is filtered through the hydrogel of the secondary filter 260. This filtered process fluid 126 from the removable collection chamber 34 can then be recirculated back to the fluid path 22 for later use. Alternatively, this filtered process fluid 126 can be recirculated back to the backflow reservoir 190 to generate the positive pressure 250 therein. In this manner, the filtered process fluid 126 can be recycled and stored in the backflow reservoir 190 for later use during a collection phase of the micro-particle filter 10. In such an aspect of the device, a dedicated portion of filtered process fluid 126 can be recycled between the backflow reservoir 190 and the secondary filter 260 of the removable collection chamber 34.

As exemplified in FIGS. 12 and 13, the backflow reservoir 190 provides a pressurized flow of process fluid 24 in the upstream direction 240 and toward the filter membrane 98. Through this configuration, the process fluid 24 moves in a reverse upstream direction 240 through the filter membrane 98 to push captured micro-sized particles 26 away from the leading surface 194 of the filter membrane 98 and toward the removable collection chamber 34. To provide this positive pressure 250 within the backflow reservoir 190, the backflow reservoir 190 can be an expandable container that can be overfilled to provide a pre-pressurized state of the backflow reservoir 190. When the second valve 212 is moved to the collection position 220, this second valve 212 closes the fluid outlet 52 and opens the backflow passage 230 and allows the positive pressure 250 built up within the backflow reservoir 190 to push the process fluid 24 in the reverse upstream direction 240 and toward the back side 232 of the filter membrane 98. The operation of the first, second and third valves 210, 212, 214 is typically dictated and operated by a controller 150 of the appliance 12 or a dedicated controller 150 for the micro-particle filter 10.

As exemplified in FIGS. 12 and 13, the movement of micro-sized particles 26 within the micro-particle filter 10 is accomplished through the movement of process fluid 24 from the fluid inlet 50 and to the fluid outlet 52, as well as from the backflow reservoir 190 and to the removable collection chamber 34. In order to prevent the inadvertent release of micro-sized particles 26 from the micro-particle filter 10, the filter membrane 98 and the secondary filter 260 are utilized for maintaining the micro-sized particles 26 within a containment area 270 that is defined between the filter membrane 98 of the filtration chamber 192 and the secondary filter 260 of the removable collection chamber 34. The filter membrane 98 and the secondary filter 260 cooperate to contain the micro-sized particles 26, direct the micro-sized particles 26 to the removable collection chamber 34 and, at the same time, prevent the inadvertent release of micro-sized particles 26, or a significant release of micro-sized particles 26, back into the fluid path 22.

According to various aspects of the device, as exemplified in FIGS. 1-13, each of the dynamic filter 90 and the filtration chamber 192 and backflow reservoir 190 can be used as the micro-particle filter 10. Alternatively, the dynamic filter 90 can be used in combination with the filtration chamber 192 and backflow reservoir 190 to operate and the micro-particle filter 10 to separate and collect the micro-sized particles 26 from the process fluid 24. In such an aspect of the device, the dynamic filter 90 can be used to separate the micro-sized particles 26 from the process fluid 24. The backflow reservoir 190, in combination with the first, second and third valves 210, 212, 214, can then be used to move the hydrophobic material 96 and the captured micro-sized particles 26 from the dynamic filtration chamber 102 to the removable collection chamber 34.

Referring now to FIGS. 1-14, having described various aspects of the device, a method 400 is disclosed for separating micro-sized particles 26 from a process fluid 24 using a micro-particle filter 10. According to the method 400, step 402 includes disposing a hydrophobic material 96 onto the filter membrane 98 of the dynamic filter 90. Step 404 of method 400 includes delivering process fluid 24 to a filter membrane 98 of the dynamic filter 90. A rotor 92 within the micro-particle filter 10 operates about a rotational axis to produce a centrifugal flow 94 of the process fluid 24 within a dynamic filtration chamber 102 (step 406). Additional process fluid 24 is delivered into the dynamic filtration chamber 102 for increasing the fluid pressure 122 within the dynamic filtration chamber 102 (step 408). Process fluid 24 is moved within the dynamic filtration chamber 102 within the centrifugal flow 94 to move the micro-sized particles 26 in a direction parallel with a filter membrane 98 while allowing the fluid pressure 122 to move the liquid component 112 of the process fluid 24 through the filtration member (step 410). After the laundry cycle is complete, or when the dynamic filtration chamber 102 is filled with micro-sized particles 26, the micro-sized particles 26 are suctioned away from the filter membrane 98 and to a removable collection chamber 34 (step 412). After the hydrophobic material 96 and the micro-sized particles 26 are suctioned away from the filter membrane 98, a new layer of the hydrophobic material 96 is applied to the filter membrane 98 (step 414). It is contemplated that as the micro-sized particles 26 accumulate on the filter membrane 98 and the hydrophobic material 96, the additional amounts and concentrations of the filter membrane 98 generate a greater filtration capability of the filter membrane 98.

Referring now to FIGS. 1-13 and 15, having described various aspects of the device, a method 500 is disclosed for separating micro-sized particles 26 from a process fluid 24 utilizing an aspect of the micro-particle filter 10. According to the method 500, process fluid 24 is delivered through a fluid path 22 (step 502). The process fluid 24 is then delivered through a filtration chamber 192 having the filter membrane 98 made of carbon nanotubes 160 (step 504). The process fluid 24 is allowed to pass through the filter membrane 98, and the micro-sized particles 26 are accumulated on the leading surface 194 of the filter membrane 98 (step 506). Valves of the micro-particle filter 10 are shifted to close a first valve 210, shift a second valve 212 to a collection position 220 and open a third valve 214 into collector outlet 216 of the removable collection chamber 34 (step 508). Process fluid 24 from a backflow reservoir 190 is directed through the fluid path 22 in a reverse upstream direction 240 and through a back side 232 of the filter membrane 98 (step 510). The process fluid 24 from the backflow reservoir 190 moves the collected or captured micro-sized particles 26 from the filtration chamber 192 and toward the removable collection chamber 34 (step 512). The process fluid 24 entering the removable collection chamber 34 is filtered using a secondary filter 260 (step 514). The micro-sized particles 26 are captured within the removable collection chamber 34 and filtered process fluid 126 is delivered from the removable collection chamber 34 after passing through the secondary filter 260 and delivered to a separate location of the appliance 12 or to an external drain 56 (step 516). The third valve 214 to the removable collection chamber 34 is closed, the first valve 210 is moved to an open position 224 and the second valve 212 is moved to a filtering position 218 to close off the backflow reservoir 190 and open the fluid path 22 (step 518).

According to the various aspects of the device, the micro-particle filter 10 can be utilized within any one of various appliances 12 that provide a flow of fluid from an external fluid source 30 and through the appliance 12. This can be done to capture micro-sized particles 26 released within the appliance 12, such as in the case of a laundry appliance 12. In addition, the appliance 12 can be utilized as a system of micro-fiber collection that is used to capture stray microfibers that may be present within a water supply from an external fluid source 30. Utilizing this system of appliances 12, including residential appliances, commercial appliances, industrial appliances and other appliances, the system of micro-fiber collection can be utilized for providing filtration to a water supply as it is cycled and recycled through a usage path. Because conventional filtration systems 60 do not typically possess filtration mechanisms that are fine enough to capture micro-sized particles 26, the system of micro-particle filters 10 can supplement current filtration methods. Utilizing large numbers of small filtration systems 60 within a large number of appliances 12, within a particular region or throughout the world, the system of micro-fiber collection described herein can be utilized to capture stray micro-sized particles 26. These micro-sized particles 26 can be continuously captured that may otherwise be released into the water supply. Utilizing these micro-particle filters 10 within a large number of appliances 12 can prevent the release of these micro-sized particles 26 into the environment.

The invention disclosed herein is further summarized in the following paragraphs and is further characterized by combinations of any and all of the various aspects described therein According to one aspect of the present disclosure, a laundry appliance includes a tub that is positioned within an outer cabinet. A processing space is defined within the tub. A fluid path delivers a process fluid through the tub for treating articles within the processing space. A micro-particle filter is positioned within the fluid path. The micro-particle filter separates micro-sized particles from the process fluid. A secondary flow mechanism delivers the micro-sized particles from the micro-particle filter to a removable collection chamber.

According to another aspect, the micro-particle filter includes a dynamic filter that has a rotor that generates a centrifugal flow of the process fluid that has the micro-sized particles entrapped therein.

According to another aspect, the dynamic filter includes a hydrophobic material that is disposed on a filter membrane that permits passage of the process fluid and captures the micro-sized particles.

According to another aspect, the laundry appliance further includes a dispensing mechanism that dispenses a layer of the hydrophobic material on the filter membrane.

According to another aspect, the rotor includes a plurality of blades.

According to another aspect, the hydrophobic material is disposed on the blades.

According to another aspect, the secondary flow mechanism is a suction mechanism that suctions the hydrophobic material and the captured micro-sized particles to the removable collection chamber.

According to another aspect, the hydrophobic material includes lysozyme crystals.

According to another aspect, the filter membrane includes carbon nanotubes.

According to another aspect, the carbon nanotubes are oriented to form one of a micro-sized mesh and a nano-sized mesh.

According to another aspect, the carbon nanotubes are oriented to form a double-wall configuration of the filter membrane.

According to another aspect, the micro-sized particles include microfibers that are made of plastic.

According to another aspect, the micro-particle filter is disposed within one of a recirculation line and a drain line of the fluid path.

According to another aspect, the micro-particle filter is disposed downstream of a primary particulate filter. The primary particulate filter is configured to separate larger particulate from the process fluid.

According to another aspect, the rotor and the filter membrane define a dynamic filtration chamber within a portion of the dynamic filter upstream of the filter membrane, wherein increased fluid pressure in the dynamic filtration chamber pushes the process fluid through the filter membrane and the plurality of blades of the rotor to define filtered process fluid and entrap the micro-sized particles within the hydrophobic material.

According to another aspect, the rotor rotates at approximately 1000 revolutions per minute to generate the centrifugal flow of the process fluid.

According to another aspect of the present disclosure, a laundry appliance includes a tub that is positioned within an outer cabinet. A processing space is defined within the tub. A fluid path delivers a process fluid through the tub for treating articles within the processing space. The fluid path has a recirculating fluid path that recirculates at least a portion of the process fluid. A primary filter is positioned within the fluid path. The primary filter separates lint particles from the process fluid. A micro-particle filter is positioned within the fluid path and is downstream of the primary filter. The micro-particle filter separates micro-sized particles from the process fluid. A secondary flow mechanism delivers the micro-sized particles from the micro-particle filter to a removable collection chamber.

According to another aspect, the micro-particle filter includes a filter membrane made up of carbon nanotubes.

According to another aspect, the removable collection chamber includes a hydrogel filter that captures the micro-sized particles and allows the process fluid to flow out from the removable collection chamber.

According to another aspect, the secondary flow mechanism is defined by a secondary flow of the process fluid through a downstream side of the micro-particle filter.

According to another aspect, a secondary flow of the process fluid is a recycled portion of the process fluid that is directed between a backflow pump chamber and the removable collection chamber.

According to another aspect, the micro-particle filter includes a dynamic filter that has a rotor that generates a centrifugal flow of the process fluid that has the micro-sized particles entrapped therein.

According to another aspect, the dynamic filter includes a hydrophobic material that is disposed on a filter membrane that permits passage of the process fluid and captures the micro-sized particles.

According to another aspect, the laundry appliance further includes a dispensing mechanism that dispenses a layer of the hydrophobic material onto the filter membrane.

According to another aspect, the rotor includes a plurality of blades.

According to another aspect, the hydrophobic material is disposed on the blades of the rotor.

According to another aspect, the secondary flow mechanism is a suction device that suctions the hydrophobic material and the captured micro-sized particles to the removable collection chamber.

According to another aspect, the hydrophobic material includes lysozyme crystals.

According to another aspect, the carbon nanotubes are oriented to form one of a micro-sized mesh and a nano-sized mesh.

According to another aspect, the carbon nanotubes are oriented to form a double-wall configuration of the filter membrane.

According to another aspect, the micro-sized particles include microfibers that are made of plastic.

According to another aspect, the rotor and the filter membrane define a dynamic filtration chamber within a portion of the dynamic filter upstream of the filter membrane, wherein increased fluid pressure in the dynamic filtration chamber pushes the process fluid through the fluid membrane and the blades of the rotor and entraps the micro-sized particles within the hydrophobic material to define filtered process fluid that is delivered downstream of the filter membrane and to further define entrapped micro-sized particles that are entrapped within the hydrophobic material.

According to another aspect, the rotor rotates at approximately 1000 revolutions per minutes to generate the centrifugal flow of the process fluid.

According to yet another aspect of the present disclosure, a particulate filtration system for a laundry appliance includes a primary filter that is positioned within a fluid path. The primary filter separates lint particles from process fluid that is delivered through the fluid path. A micro-particle filter is positioned within the fluid path and is downstream of the primary filter. The micro-particle filter separates micro-sized particles from the process fluid. A secondary flow mechanism delivers the micro-sized particles from the micro-particle filter to a removable collection chamber. The secondary flow mechanism is defined by a secondary flow of the process fluid through a downstream side of the micro-particle filter, and a secondary flow of the process fluid is a recycled portion of the process fluid that is directed between a backflow pump chamber and the removable collection chamber.

According to another aspect, the micro-particle filter includes a filter membrane made up of carbon nanotubes.

According to another aspect, the removable collection chamber includes a hydrogel membrane that captures the micro-sized particles and allows the process fluid to flow out from the removable collection chamber.

According to another aspect, the micro-particle filter includes a dynamic filter that has a rotor that generates a centrifugal flow of the process fluid that has the micro-sized particles entrapped therein.

According to another aspect, the dynamic filter includes a hydrophobic material that is disposed on a filter membrane that permits passage of the process fluid and captures the micro-sized particles.

According to another aspect, the particulate filtration system further includes a hydrophobic material that is disposed on a filter membrane that permits passage of the process fluid and captures the micro-sized particles.

According to another aspect, the particulate filtration system further includes a dispensing mechanism that dispenses a layer of the hydrophobic material onto the filter membrane.

According to another aspect, the rotor includes a plurality of blades.

According to another aspect, the hydrophobic material is disposed on the blades.

According to another aspect, the secondary flow mechanism is a suction device that suctions the hydrophobic material of the hydrogel membrane and the captured micro-sized particles to the removable collection chamber.

According to another aspect, the hydrophobic material of the hydrogel membrane includes lysozyme crystals.

According to another aspect, the carbon nanotubes are oriented to form one of a micro-sized mesh and a nano-sized mesh.

According to another aspect, the carbon nanotubes are oriented to form a micro-sized mesh and a nano-sized mesh.

According to another aspect, the micro-sized particles include microfibers that are made of plastic.

According to another aspect, the rotor and the filter membrane define a dynamic filtration chamber within a portion of the dynamic filter upstream of the filter membrane, wherein increased fluid pressure in the dynamic filtration chamber pushes process fluid through the fluid membrane and the plurality of blades of the rotor and entraps the micro-sized particles within the hydrophobic material.

According to another aspect, the rotor rotates at approximately 1000 revolutions per minutes to generate the centrifugal flow of the process fluid.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry appliance comprising:

a tub positioned within an outer cabinet, wherein a processing space is defined within the tub;

a fluid path that delivers a process fluid through the tub for treating articles within the processing space;

a micro-particle filter positioned within the fluid path, wherein the micro-particle filter separates micro-sized particles from the process fluid; and a secondary flow mechanism that delivers the micro-sized particles from the micro-particle filter to a removable collection chamber.

2. The laundry appliance of claim 1, wherein the micro-particle filter includes a dynamic filter having a rotor that generates a centrifugal flow of the process fluid having the micro-sized particles entrapped therein.

3. The laundry appliance of claim 2, wherein the dynamic filter includes a hydrophobic material disposed on a filter membrane that permits passage of the process fluid and captures the micro-sized particles, wherein the hydrophobic material is disposed at least on the filter membrane.

4. The laundry appliance of claim 3, wherein the rotor includes a plurality of blades, and wherein the hydrophobic material is disposed at least on the blades.

5. The laundry appliance of claim 3, wherein the secondary flow mechanism is a suction mechanism that suctions the hydrophobic material and the captured micro-sized particles to the removable collection chamber.

6. The laundry appliance of claim 3, wherein the filter membrane includes carbon nanotubes that are oriented to form a mesh structure.

7. The laundry appliance of claim 1, wherein the micro-particle filter is disposed downstream of a primary particulate filter, wherein the primary particulate filter is configured to separate larger particulate from the process fluid.

8. The laundry appliance of claim 4, wherein the rotor and the filter membrane define a dynamic filtration chamber within a portion of the dynamic filter upstream of the filter membrane, wherein increased fluid pressure in the dynamic filtration chamber pushes the process fluid through the filter membrane and the plurality of blades of the rotor, to define filtered process fluid, and entraps the micro-sized particles within the hydrophobic material.

9. A laundry appliance comprising:

a tub positioned within an outer cabinet, wherein a processing space is defined within the tub;

a fluid path that delivers a process fluid through the tub for treating articles within the processing space, the fluid path having a recirculating fluid path that recirculates at least a portion of the process fluid;

a primary filter positioned within the fluid path, wherein the primary filter separates lint particles from the process fluid;

a micro-particle filter positioned within the fluid path and downstream of the primary filter, wherein the micro-particle filter separates micro-sized particles from the process fluid; and a secondary flow mechanism that delivers the micro-sized particles from the micro-particle filter to a removable collection chamber.

10. The laundry appliance of claim 9, wherein the micro-particle filter includes a filter membrane made up of carbon nanotubes that form a double-wall configuration of the filter membrane.

11. The laundry appliance of claim 9, wherein the removable collection chamber includes a hydrogel filter that captures the micro-sized particles and allows the process fluid to flow out from the removable collection chamber.

12. The laundry appliance of claim 9, wherein the secondary flow mechanism is defined by a secondary flow of the process fluid through a downstream side of the micro-particle filter.

13. The laundry appliance of claim 10, wherein the micro-particle filter includes a dynamic filter having a rotor that generates a centrifugal flow of the process fluid having the micro-sized particles entrapped therein, the dynamic filter also having a hydrophobic material disposed at least on the filter membrane that permits passage of the process fluid and captures the micro-sized particles, wherein the hydrophobic material includes at least lysozyme crystals.

14. The laundry appliance of claim 13, wherein the secondary flow mechanism is a suction device that suctions the hydrophobic material and the captured micro-sized particles to the removable collection chamber.

15. A particulate filtration system for a laundry appliance, the particulate filtration system comprising:

a primary filter positioned within a fluid path, wherein the primary filter separates lint particles from process fluid delivered through the fluid path;

a micro-particle filter positioned within the fluid path and downstream of the primary filter, wherein the micro-particle filter separates micro-sized particles from the process fluid; and a secondary flow mechanism that delivers the micro-sized particles from the micro-particle filter to a removable collection chamber, wherein the secondary flow mechanism is defined by a secondary flow of the process fluid through a downstream side of the micro-particle filter, and the secondary flow of the process fluid is a recycled portion of the process fluid that is directed between a backflow pump chamber and the removable collection chamber.

16. The particulate filtration system of claim 15, wherein the removable collection chamber includes a hydrogel membrane that captures the micro-sized particles and allows the process fluid to flow out from the removable collection chamber.

17. The particulate filtration system of claim 15, wherein the micro-particle filter includes a dynamic filter having a rotor that generates a centrifugal flow of the process fluid having the micro-sized particles entrapped therein.

18. The particulate filtration system of claim 17, wherein the dynamic filter includes a filter membrane made up of carbon nanotubes and hydrophobic material disposed on the filter membrane that permits passage of the process fluid and captures the micro-sized particles.

19. The particulate filtration system of claim 16, wherein the secondary flow mechanism is a suction device that suctions a hydrophobic material of the hydrogel membrane and the captured micro-sized particles to the removable collection chamber.

20. The particulate filtration system of claim 18, wherein the rotor and the filter membrane define a dynamic filtration chamber within a portion of the dynamic filter upstream of the filter membrane, wherein increased fluid pressure in the dynamic filtration chamber pushes filtered process fluid through the filter membrane and a plurality of blades of the rotor and entraps the micro-sized particles within the hydrophobic material.

* * * * *